US006995678B2

(12) United States Patent
Wey

(10) Patent No.: US 6,995,678 B2
(45) Date of Patent: Feb. 7, 2006

(54) GAS SAFETY DETECTOR HAVING SELF-DETECTION FUNCTION

(75) Inventor: Jing-Cherng Wey, Chiayi (TW)

(73) Assignee: Kaily Technology Co., Ltd., Chiayi (TW)

( * ) Notice: Subject to any disclaimer, the term of this patent is extended or adjusted under 35 U.S.C. 154(b) by 97 days.

(21) Appl. No.: 10/726,189

(22) Filed: Dec. 1, 2003

(65) Prior Publication Data

US 2005/0116832 A1 Jun. 2, 2005

(51) Int. Cl.
*G08B 17/00* (2006.01)

(52) U.S. Cl. ..... 340/632; 340/514; 340/627; 73/1.05; 364/496

(58) Field of Classification Search ..... 340/632–634, 340/514, 515, 628–630; 73/23.2, 24, 25, 73/37, 31

See application file for complete search history.

(56) References Cited

U.S. PATENT DOCUMENTS

| | | | | |
|---|---|---|---|---|
| 2,673,339 | A * | 3/1954 | Gray et al. | 340/532 |
| 3,693,401 | A * | 9/1972 | Purt et al. | 73/1.05 |
| 5,526,280 | A * | 6/1996 | Consadori et al. | 702/24 |
| 6,307,478 | B1 * | 10/2001 | Thompson | 340/632 |
| 6,741,181 | B2 * | 5/2004 | Skaggs | 340/632 |
| 2002/0157455 | A1 * | 10/2002 | Sagi et al. | 73/40 |
| 2004/0035179 | A1 * | 2/2004 | Koch | 73/1.05 |

* cited by examiner

*Primary Examiner*—Jeffery Hofsass
(74) *Attorney, Agent, or Firm*—Alan D. Kamrath; Nikolai & Mersereau, P.A.

(57) ABSTRACT

A gas safety detector includes a base board, a step motor, a sleeve, a drive rod, a gas device, a link, and a sensor. Thus, the gas enters the sensor to perform a self test to identify if the sensor is operated at the normal state, so that the gas safety detector has a self-detection function to detect the working state of the sensor so as to assure the safety of the gas safety detector when in use.

8 Claims, 3 Drawing Sheets

GAS SAFETY DETECTOR HAVING SELF-DETECTION FUNCTION

BACKGROUND OF THE INVENTION

1. Field of the Invention

The present invention relates to a gas safety detector, and more particularly to a gas safety detector having a self-detection function.

2. Description of the Related Art

A conventional gas safety detector comprises a sensor mounted on the ceiling to detect existence of the gas. When the sensor detects that the gas concentration in a site such as the house or the like exceeds a predetermined limit, the gas safety detector emits an alarm signal by buzzing or the like so as to warn the user, thereby protecting the user's safety. However, the gas safety detector cannot be operated normally when the sensor is inoperative or worn out, thereby causing danger to the user.

SUMMARY OF THE INVENTION

The primary objective of the present invention is to provide a gas safety detector having a self-detection function.

Another objective of the present invention is to provide a gas safety detector, wherein the gas enters the sensor to perform a self test to identify if the sensor is operated at the normal state, so that the gas safety detector has a self-detection function to detect the working state of the sensor so as to assure the safety of the gas safety detector when in use.

In accordance with the present invention, there is provided a gas safety detector, comprising:

a base board;

a step motor mounted on a first side of the base board;

a sleeve rotatably mounted on the step motor;

a drive rod mounted on a periphery of the sleeve to rotate therewith;

a gas device mounted on a second side of the base board and having an end provided with a retractable nozzle;

a link pivotally mounted on the base board and having a first end rested on and driven by the drive rod and a second end formed with a hook portion hooked on the nozzle of the gas device; and a sensor mounted on the second side of the base board and located adjacent to the nozzle of the gas device.

Further benefits and advantages of the present invention will become apparent after a careful reading of the detailed description with appropriate reference to the accompanying drawings.

DETAILED DESCRIPTION OF THE INVENTION

Figure 1:
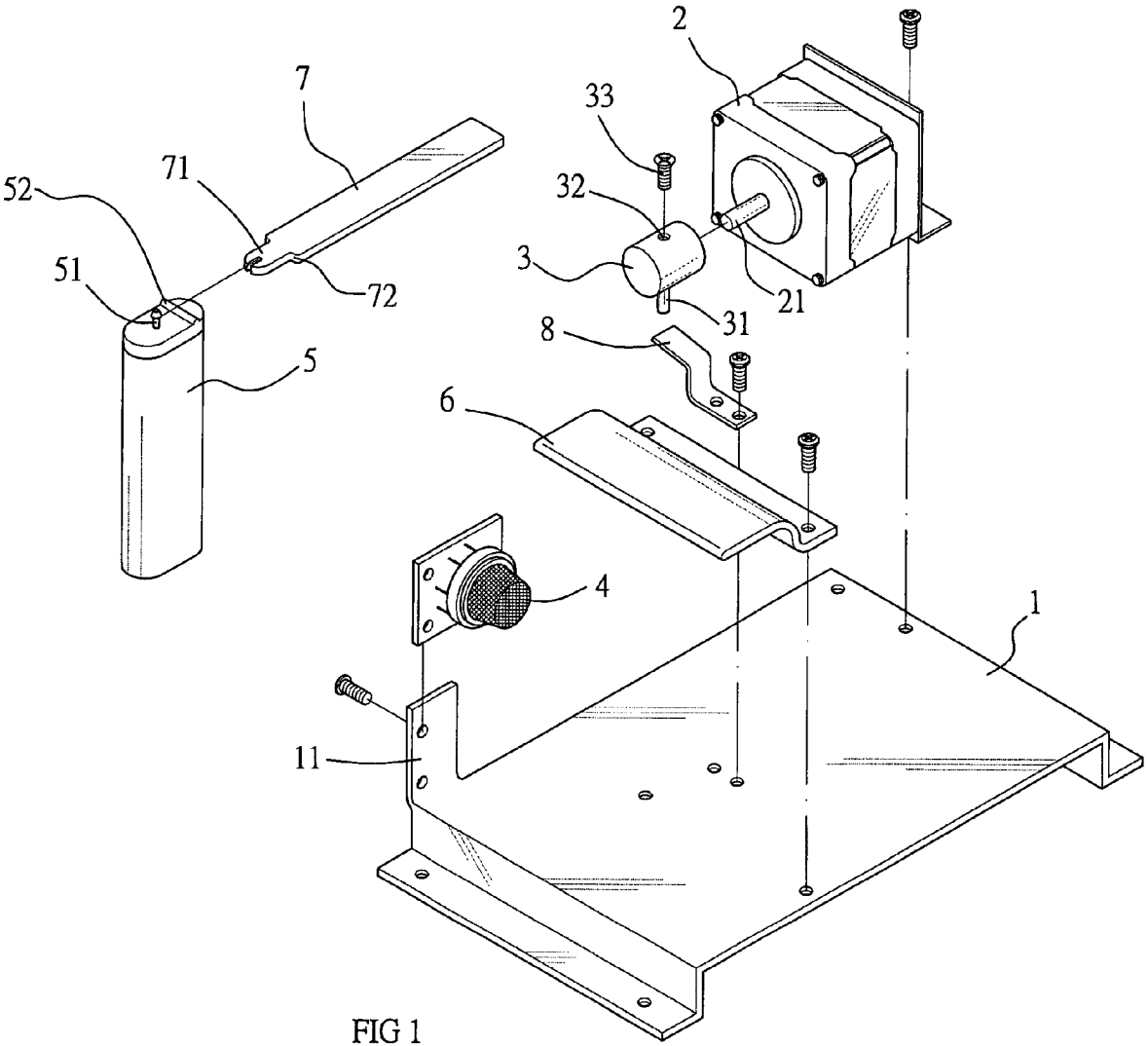
FIG. 1 is an exploded perspective view of a gas safety detector in accordance with the preferred embodiment of the present invention.
Figure 2:
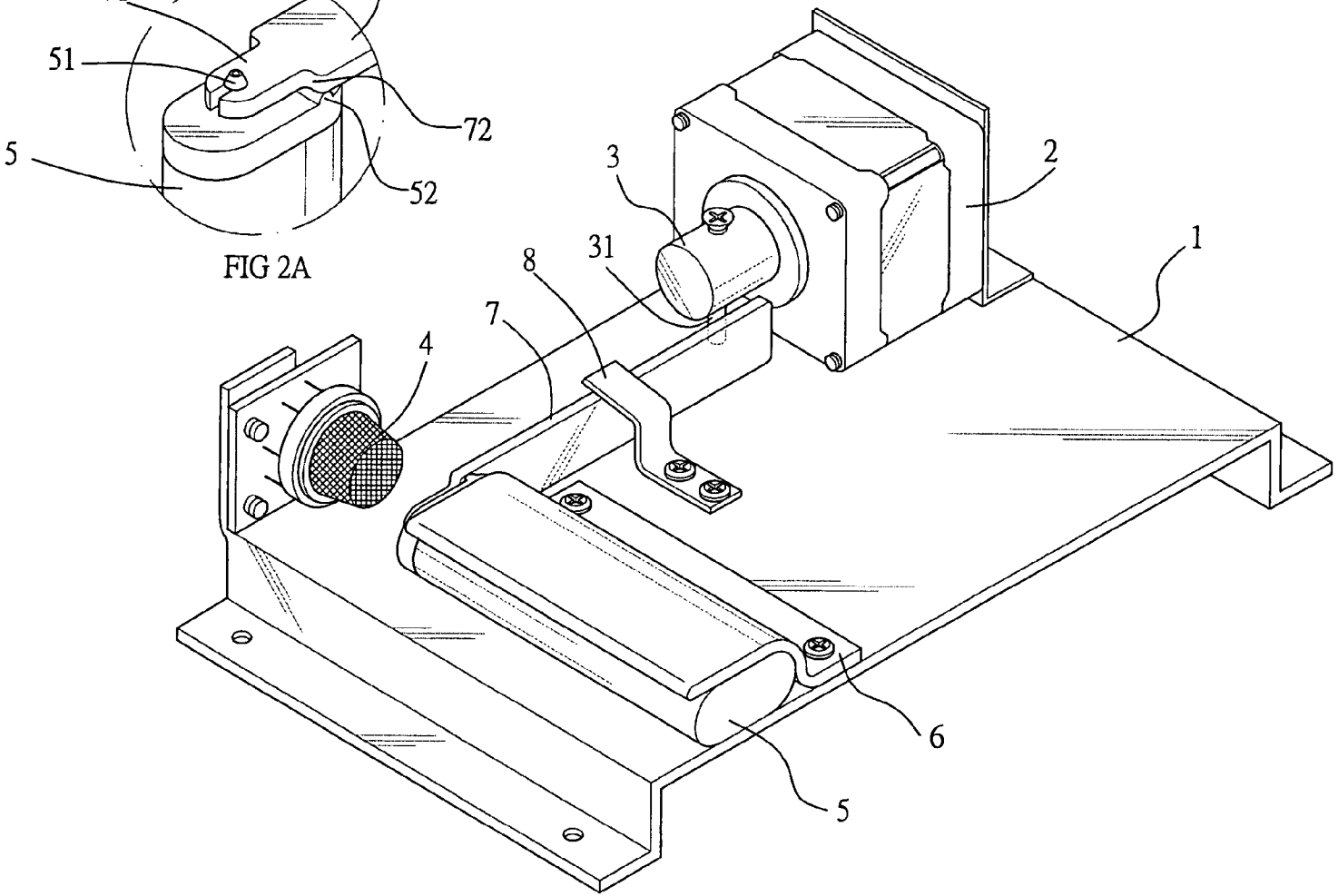
FIG. 2 is a perspective assembly view of the gas safety detector in accordance with the preferred embodiment of the present invention.
Figure 2A:
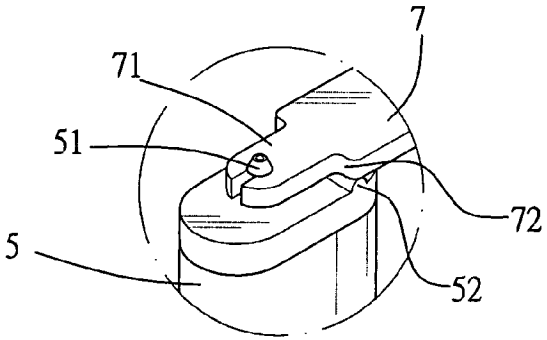
FIG. 2A is a partially enlarged view of the gas safety detector as shown in FIG. 2.

Referring to the drawings and initially to FIGS. 1, 2 and 2A, a gas safety detector in accordance with the preferred embodiment of the present invention comprises a base board 1, a step motor 2 mounted on a first side of the base board 1, a sleeve 3 rotatably mounted on the step motor 2, a drive rod 31 mounted on a periphery of the sleeve 3 to rotate therewith, a gas device 5 mounted on a second side of the base board 1 and having an end provided with a retractable nozzle 51, a link 7 pivotally mounted on the base board 1 and having a first end rested on and driven by the drive rod 31 and a second end formed with a hook portion 71 hooked on the nozzle 51 of the gas device 5, and a sensor 4 mounted on the second side of the base board 1 and located adjacent to the nozzle 51 of the gas device 5.

The second side of the base board 1 is formed with an upright support plate 11, and the sensor 4 is secured on the support plate 11 of the base board 1.

The step motor 2 is provided with a rotation shaft 21, and the sleeve 3 is secured on the rotation shaft 21 of the step motor 2 to rotate therewith. The sleeve 3 has a periphery formed with a screw bore 32, and the gas safety detector further comprises a screw 33 screwed into the screw bore 32 of the sleeve 3 and urged on the rotation shaft 21 of the step motor 2, so that the sleeve 3 is secured on the rotation shaft 21 of the step motor 2.

The gas safety detector further comprises a substantially Z-shaped catch plate 8 having a first end secured on the base board 1 and a second end rested on a mediate portion of the link 7, and a substantially Z-shaped press plate 6 having a first end secured on the base board 1 and a second end rested on the gas device 5.

The gas device 5 is formed with a rib 52 located adjacent to the nozzle 51, and the second end of the link 7 is formed with a shoulder 72 located adjacent to the hook portion 71 and rested on the rib 52 of the gas device 5.

Figures 3, 3A:
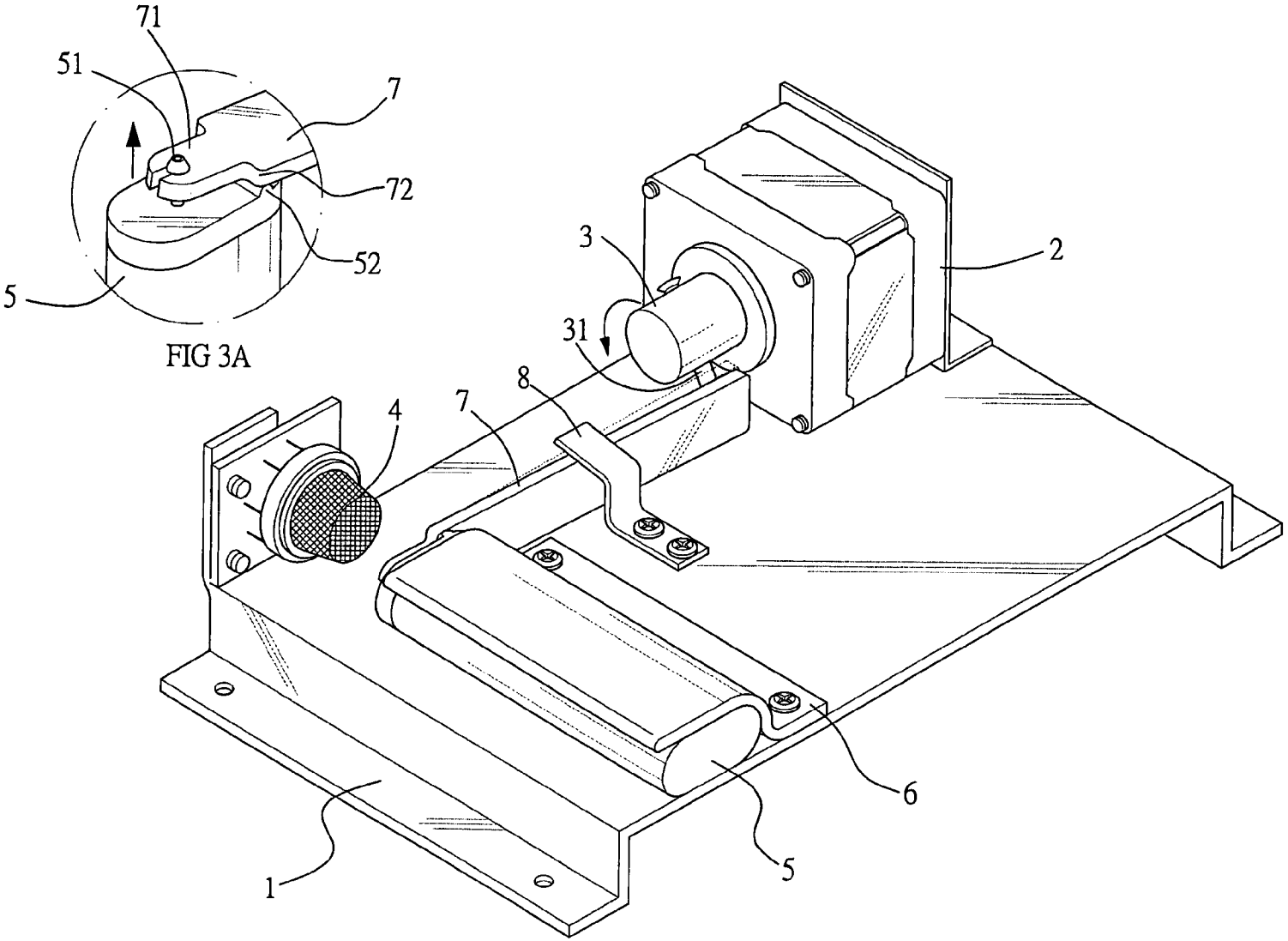
FIG. 3 is a schematic operational view of the gas safety detector as shown in FIG. 2.
FIG. 3A is a schematic operational view of the gas safety detector as shown in FIG. 2A.

In operation, referring to FIGS. 3 and 3A with reference to FIGS. 1, 2 and 2A, the sleeve 3 is rotated by the rotation shaft 21 of the step motor 2 to rotate the drive rod 31 which presses and moves the first end of the link 7 so as to pivot the link 7 by a linkage action to drive the hook portion 71 at the second end of the link 7 to pull the nozzle 51 of the gas device 5 outward, so that the gas contained in the gas device 5 is ejected outward. At this time, the link 7 is limited by the catch plate 8 to prevent deflection of the link 7 due to an excessive hit of the drive rod 31 of the sleeve 3.

After the gas is ejected outward the gas device 5, the step motor 2 is operated reversely to return the drive rod 31 to the original position to release the link 7 which releases the hook portion 71, so that the retractable nozzle 51 of the gas device 5 is returned to the original position to stop flow of the gas.

In practice, if the sensor 4 can detect the gas and emits a normal signal after the gas enters the sensor 4, it indicates that the sensor 4 is operated at the normal state. Alternatively, if the sensor 4 cannot detect the gas and emits a normal signal after the gas enters the sensor 4, it indicates that the sensor 4 is not operated at the normal state. Thus, the sensor 4 needs to be repaired or replaced for safety.

Accordingly, the gas enters the sensor 4 to perform a self test to identify if the sensor 4 is operated at the normal state, so that the gas safety detector has a self-detection function to detect the working state of the sensor 4 so as to assure the safety of the gas safety detector when in use.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A gas safety detector, comprising:

a base board;

a step motor mounted on a first side of the base board;

a sleeve rotatably mounted on the step motor;

a drive rod mounted on a periphery of the sleeve to rotate therewith;

a gas device mounted on a second side of the base board and having an end provided with a retractable nozzle;

a link pivotally mounted on the base board and having a first end rested on and driven by the drive rod and a second end formed with a hook portion hooked on the nozzle of the gas device; and a sensor mounted on the second side of the base board and located adjacent to the nozzle of the gas devices;

whereby the sensor is tested by releasing gas from the gas device.

2. The gas safety detector in accordance with claim 1, wherein the second side of the base board is formed with an upright support plate, and the sensor is secured on the support plate of the base board.

3. The gas safety detector in accordance with claim 1, wherein the step motor is provided with a rotation shaft, and the sleeve is secured on the rotation shaft of the step motor to rotate therewith.

4. The gas safety detector in accordance with claim 1, wherein the sleeve has a periphery formed with a screw bore, and the gas safety detector further comprises a screw screwed into the screw bore of the sleeve and urged on the rotation shaft of the step motor, so that the sleeve is secured on the rotation shaft of the step motor.

5. The gas safety detector in accordance with claim 1, further comprising a substantially Z-shaped catch plate having a first end secured on the base board and a second end rested on a mediate portion of the link.

6. The gas safety detector in accordance with claim 1, further comprising a substantially Z-shaped press plate having a first end secured on the base board and a second end rested on the gas device.

7. The gas safety detector in accordance with claim 1, wherein the gas device is formed with a rib located adjacent to the nozzle, and the second end of the link is formed with a shoulder located adjacent to the hook portion and rested on the rib of the gas device.

8. The gas safety detector in accordance with claim 5, wherein the link is limited by the catch plate to prevent deflection of the link due to an excessive hit of the drive rod of the sleeve.

* * * * *